US010301556B2

(12) United States Patent
Al-Ghamdi et al.

(10) Patent No.: US 10,301,556 B2
(45) Date of Patent: May 28, 2019

(54) SYSTEMS AND METHODS FOR THE CONVERSION OF FEEDSTOCK HYDROCARBONS TO PETROCHEMICAL PRODUCTS

(71) Applicant: Saudi Arabian Oil Company, Dhahran (SA)

(72) Inventors: Sameer A. Al-Ghamdi, Dhahran (SA); Essam Al-Sayed, Al-Khobar (SA); Ibrahim Abba, Dhahran (SA); Abdennour Bourane, Ras Tanura (SA); Alberto Lozano Ballesteros, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/683,071

(22) Filed: Aug. 22, 2017

(65) Prior Publication Data

US 2018/0057758 A1 Mar. 1, 2018

Related U.S. Application Data

(60) Provisional application No. 62/378,988, filed on Aug. 24, 2016.

(51) Int. Cl.

| | |
|---|---|
| ***C10G 9/00*** | (2006.01) |
| ***C10G 51/06*** | (2006.01) |
| ***C10G 67/00*** | (2006.01) |
| ***C10G 69/14*** | (2006.01) |
| ***C10G 45/02*** | (2006.01) |
| ***C10G 47/30*** | (2006.01) |
| ***C10G 9/36*** | (2006.01) |
| ***C10G 11/18*** | (2006.01) |

(52) U.S. Cl.

CPC ..... *C10G 51/06* (2013.01); *C10G 9/36* (2013.01); *C10G 11/18* (2013.01); *C10G 45/02* (2013.01); *C10G 47/30* (2013.01); *C10G 67/00* (2013.01); *C10G 69/14* (2013.01); *C10G 2300/301* (2013.01); *C10G 2400/20* (2013.01)

(58) Field of Classification Search

CPC ..... C10G 9/00; C10G 51/06; C10G 67/00; C10G 69/14

See application file for complete search history.

(56) References Cited

U.S. PATENT DOCUMENTS

| | | | | |
|---|---|---|---|---|
| 2,358,150 | A * | 9/1944 | Cooke | C10G 51/06 208/73 |
| 3,617,493 | A | 11/1971 | Wirth et al. | |
| 3,730,879 | A | 5/1973 | Christman et al. | |
| 3,755,143 | A | 8/1973 | Hosoi et al. | |
| 3,830,720 | A | 8/1974 | Misaki et al. | |
| 3,856,659 | A | 12/1974 | Owen | |
| 3,862,838 | A | 1/1975 | Sloboda | |
| 3,862,898 | A * | 1/1975 | Boyd | C10G 51/02 208/73 |
| 3,876,523 | A | 4/1975 | Rosinski | |
| 4,016,067 | A | 4/1977 | Fischer et al. | |
| 4,133,777 | A | 1/1979 | Frayer et al. | |
| 4,134,824 | A | 1/1979 | Kamm et al. | |
| 4,153,539 | A | 5/1979 | Herrington et al. | |
| 4,264,435 | A | 4/1981 | Read et al. | |
| 4,297,203 | A | 10/1981 | Ford et al. | |
| 4,527,003 | A | 7/1985 | Okamoto et al. | |
| 4,587,011 | A | 5/1986 | Okamoto et al. | |
| 4,655,904 | A | 4/1987 | Okamoto et al. | |
| 4,725,349 | A | 2/1988 | Okamoto et al. | |
| 4,830,728 | A | 5/1989 | Herbst et al. | |
| 4,992,160 | A | 2/1991 | Long et al. | |
| 5,171,331 | A | 12/1992 | Debras et al. | |
| 5,523,502 | A * | 6/1996 | Rubin | C07C 11/04 568/697 |
| 5,603,824 | A | 2/1997 | Kyan et al. | |
| 5,871,650 | A | 2/1999 | Lai et al. | |
| 5,904,837 | A | 5/1999 | Fujiyama | |

(Continued)

FOREIGN PATENT DOCUMENTS

| | | |
|---|---|---|
| EP | 1600491 A1 | 11/2005 |
| GB | 978576 | 12/1964 |

(Continued)

OTHER PUBLICATIONS

Baric, John, "Next-Level Hydrocracker Flexibility: Unlocking High Pertormance in Today's Turbulent Markets", Shell Global Solutions, 2016, 3-18.

Ding et al., "LCO Hydrotreating with Mo—Ni and W—Ni Supported on Nano- and Micro-Sized Zeolite Beta", Applied Catalysis A: General, 2009, 353 17-23.

Garcia-Martinez et al., "Mesostructured Zeolite Y-High Hydrothermal Stability and Superior FCC Catalytic Performance", Catal. Sci. Technol., 2012, 2, 987-994.

(Continued)

*Primary Examiner* — Randy Boyer

(74) *Attorney, Agent, or Firm* — Dinsmore & Shol LLP

(57) ABSTRACT

According to an embodiment disclosed, a feedstock hydrocarbon may be processed by a method which may include separating the feedstock hydrocarbon into a lesser boiling point hydrocarbon fraction and a greater boiling point hydrocarbon fraction, cracking the greater boiling point hydrocarbon fraction in a high-severity fluid catalytic cracking reactor unit to form a catalytically cracked effluent, cracking the lesser boiling point hydrocarbon fraction in a steam cracker unit to form a steam cracked effluent, and separating one or both of the catalytically cracked effluent or the steam cracked effluent to form two or more petrochemical products. In one or more embodiments, the feedstock hydrocarbon may include crude oil and one of the petrochemical products may include light olefins.

22 Claims, 3 Drawing Sheets

(56) References Cited

U.S. PATENT DOCUMENTS

| | | | |
|---|---|---|---|
| 5,906,728 | A | 5/1999 | Iaccino et al. |
| 5,951,850 | A | 9/1999 | Ino et al. |
| 5,954,947 | A | 9/1999 | Mignard et al. |
| 6,033,555 | A | 3/2000 | Chen et al. |
| 6,123,830 | A | 9/2000 | Gupta et al. |
| 6,190,533 | B1 | 2/2001 | Bradow et al. |
| 6,190,538 | B1 | 2/2001 | Gosselink et al. |
| 6,210,562 | B1 | 4/2001 | Xie et al. |
| 6,316,674 | B1 | 11/2001 | Kantam et al. |
| 6,384,285 | B1 | 5/2002 | Choudary et al. |
| 6,656,346 | B2 | 12/2003 | Ino et al. |
| 6,743,961 | B2 | 6/2004 | Powers |
| 6,811,684 | B2 | 11/2004 | Mohr et al. |
| 6,979,757 | B2 | 12/2005 | Powers |
| 6,982,074 | B2 | 1/2006 | Jan et al. |
| 7,019,187 | B2 | 3/2006 | Powers |
| 7,094,333 | B2 | 8/2006 | Yang et al. |
| 7,374,664 | B2 | 5/2008 | Powers |
| 7,396,449 | B2 | 7/2008 | Powers |
| 7,404,889 | B1 | 7/2008 | Powers |
| 7,419,584 | B2 | 9/2008 | Stell et al. |
| 7,550,642 | B2 | 6/2009 | Powers |
| 7,744,747 | B2 | 6/2010 | Halsey |
| 7,785,563 | B2 | 8/2010 | Ryoo et al. |
| 7,858,834 | B2 | 12/2010 | Powers |
| 7,972,498 | B2 | 7/2011 | Buchanan et al. |
| 9,096,806 | B2 | 8/2015 | Abba et al. |
| 9,228,139 | B2 | 1/2016 | Shafi et al. |
| 9,228,140 | B2 | 1/2016 | Abba et al. |
| 9,228,141 | B2 | 1/2016 | Sayed et al. |
| 9,255,230 | B2 | 2/2016 | Shafi et al. |
| 9,279,088 | B2 | 3/2016 | Shafi et al. |
| 9,284,497 | B2 | 3/2016 | Bourane et al. |
| 9,284,501 | B2 | 3/2016 | Sayed et al. |
| 9,284,502 | B2 | 3/2016 | Bourane et al. |
| 9,296,961 | B2 | 3/2016 | Shafi et al. |
| 2006/0118462 | A1 | 6/2006 | Schulze-Trautmann et al. |
| 2006/0207917 | A1 | 9/2006 | Domokos et al. |
| 2006/0260981 | A1 | 11/2006 | Gosling |
| 2007/0090018 | A1 | 4/2007 | Keusenkothen et al. |
| 2008/0277314 | A1 | 11/2008 | Halsey |
| 2008/0283445 | A1 | 11/2008 | Powers |
| 2009/0050523 | A1 | 2/2009 | Halsey |
| 2009/0218255 | A1 | 9/2009 | Claude et al. |
| 2009/0272674 | A1 | 11/2009 | Zheng et al. |
| 2010/0018904 | A1 | 1/2010 | Kressmann et al. |
| 2010/0155293 | A1 | 6/2010 | Verstraete et al. |
| 2010/0230323 | A1 | 9/2010 | Ancheyta Juárez et al. |
| 2011/0083996 | A1 | 4/2011 | Shafi et al. |
| 2013/0197285 | A1 | 8/2013 | Shafi et al. |
| 2013/0220884 | A1 | 8/2013 | Bourane et al. |
| 2013/0248416 | A1 | 9/2013 | Shafi et al. |
| 2013/0248417 | A1 | 9/2013 | Sayed et al. |
| 2013/0248419 | A1 | 9/2013 | Abba et al. |
| 2014/0221712 | A1 | 8/2014 | Greene et al. |
| 2015/0001130 | A1 | 1/2015 | Akhras et al. |
| 2016/0369185 | A1 | 12/2016 | Ward et al. |

FOREIGN PATENT DOCUMENTS

| | | | |
|---|---|---|---|
| WO | 2015000847 | A1 | 1/2015 |
| WO | 2015128040 | A1 | 9/2015 |
| WO | 2015128041 | A1 | 9/2015 |
| WO | 2016059569 | A1 | 4/2016 |

OTHER PUBLICATIONS

International Search Report and Written Opinion pertaining to PCT/US2017/026498 dated Jun. 30, 2017.

International Search Report and Written Opinion pertaining to PCT/US2017/035202 dated Aug. 7, 2017.

International Search Report and Written Opinion pertaining to PCT/US2017/048130 dated Oct. 18, 2017.

Liu et al., "Y/MCM-41 Composites Assembled from Nanocrystals", Microporous and Mesoporous Materials, 2013, 181, 116-122.

Varoshiotis, Andy, "Cyprus New Energy Economy Focus Should be in the Petrochemicals", 2015, Linkedin.

Zhang et al., "Preparation and Characterization of Beta/MCM-41 Composite Zeolite with a Stepwise-Distributed Pore Structure", Powder Technology, 2008, 73-78.

International Search Report and Written Opinion pertaining to PCT/US2018/028592 dated Jun. 27, 2018.

Penrose et al., "Enhancing Refinery Profitability by Gasification, Hydroprocessing & Power Generation", Gasification Technologies Conference, Oct. 1999, San Francisco, CA., Texaco Power & Gasification.

Rana et al., "A Review of Recent Advances on Process Technologies for Upgrading of Heavy Oils and Residua", Fuel, 2007, 86, 1216-1231.

International Search Report and Written Opinion pertaining to PCT/US2018/042016 dated Oct. 8, 2018.

International Search Report and Written Opinion pertaining to PCT/US2018/042020 dated Oct. 8, 2018.

International Search Report and Written Opinion pertaining to International Application No. PCT/US2018/042011 dated Jan. 2, 2019, 20 pages.

International Search Report and Written Opinion pertaining to International Application No. PCT/US2018/042015 dated Jan. 2, 2019, 20 pages.

Examination Report dated Dec. 31, 2018 pertaining to GCC Patent Application No. GC 2017133492, 6 pages.

* cited by examiner

SYSTEMS AND METHODS FOR THE CONVERSION OF FEEDSTOCK HYDROCARBONS TO PETROCHEMICAL PRODUCTS

CROSS REFERENCE TO RELATED APPLICATION

This application claims benefit to U.S. Provisional Application 62/378,988 filed Aug. 24, 2016, which is incorporated by reference in its entirety.

BACKGROUND

Field

The present disclosure relates to the production of petrochemical products and, more particularly, to systems and method for the direct production of petrochemical products from feedstock hydrocarbons.

Technical Background

Ethylene, propylene, butenes, butadiene, and aromatic compounds such as benzene, toluene, and xylene are basic intermediates for a large portion of the petrochemical industry. They are mainly obtained through the thermal cracking (sometimes referred to as "steam pyrolysis" or "steam cracking") of petroleum gases and distillates such as naphtha, kerosene, or even gas oil. However, as demands rise for these basic intermediate compounds, other production sources must be considered beyond traditional thermal cracking processes utilizing petroleum gases and distillates as feedstocks.

These intermediate compounds may also be produced through refinery fluidized catalytic cracking (FCC) processes, where heavy feedstocks such as gas oils or residues are converted. For example, an important source for propylene production is refinery propylene from FCC units. However, the distillate feedstocks such as gas oils or residues are usually limited and result from several costly and energy intensive processing steps within a refinery.

BRIEF SUMMARY

Accordingly, in view of the ever growing demand of these intermediary petrochemical products, such as light olefins, there is a need for processes to produce these intermediate compounds from other types of feedstocks that are available in large quantities at relatively low cost. The present disclosure is related to processes and systems for producing these intermediate compounds, sometimes referred to in this disclosure as "system products," by the direct conversion of feedstock hydrocarbons such as crude oil. For example, conversion from a crude oil feedstock may be beneficial as compared with other feedstocks in producing these intermediate compounds because it is generally less expensive and more widely available than other feedstock materials.

According to one or more embodiments, a feedstock hydrocarbon may be processed by a method which may comprise separating the feedstock hydrocarbon into a lesser boiling point hydrocarbon fraction and a greater boiling point hydrocarbon fraction, cracking the greater boiling point hydrocarbon fraction in a high-severity fluid catalytic cracking reactor unit to form a catalytically cracked effluent, cracking the lesser boiling point hydrocarbon fraction in a steam cracker unit to form a steam cracked effluent, and separating one or both of the catalytically cracked effluent or the steam cracked effluent to form two or more petrochemical products. In one or more embodiments, the feedstock hydrocarbon may comprise crude oil and one of the petrochemical products may comprise one or more light olefins.

According to another embodiment, a feedstock hydrocarbon may be processed by a method comprising introducing a feedstock hydrocarbon stream to a feedstock hydrocarbon separator that separates the feedstock hydrocarbon into a lesser boiling point hydrocarbon fraction stream and a greater boiling point hydrocarbon fraction stream, passing the greater boiling point hydrocarbon fraction stream to a high-severity fluid catalytic cracking reactor unit that cracks the greater boiling point hydrocarbon fraction stream to form a catalytically cracked effluent stream, passing the lesser boiling point hydrocarbon fraction stream to a steam cracker unit that cracks the lesser boiling point hydrocarbon fraction stream to form a steam cracked effluent stream, and separating one or both of the catalytically cracked effluent stream or the steam cracked effluent stream to form two or more petrochemical product streams.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
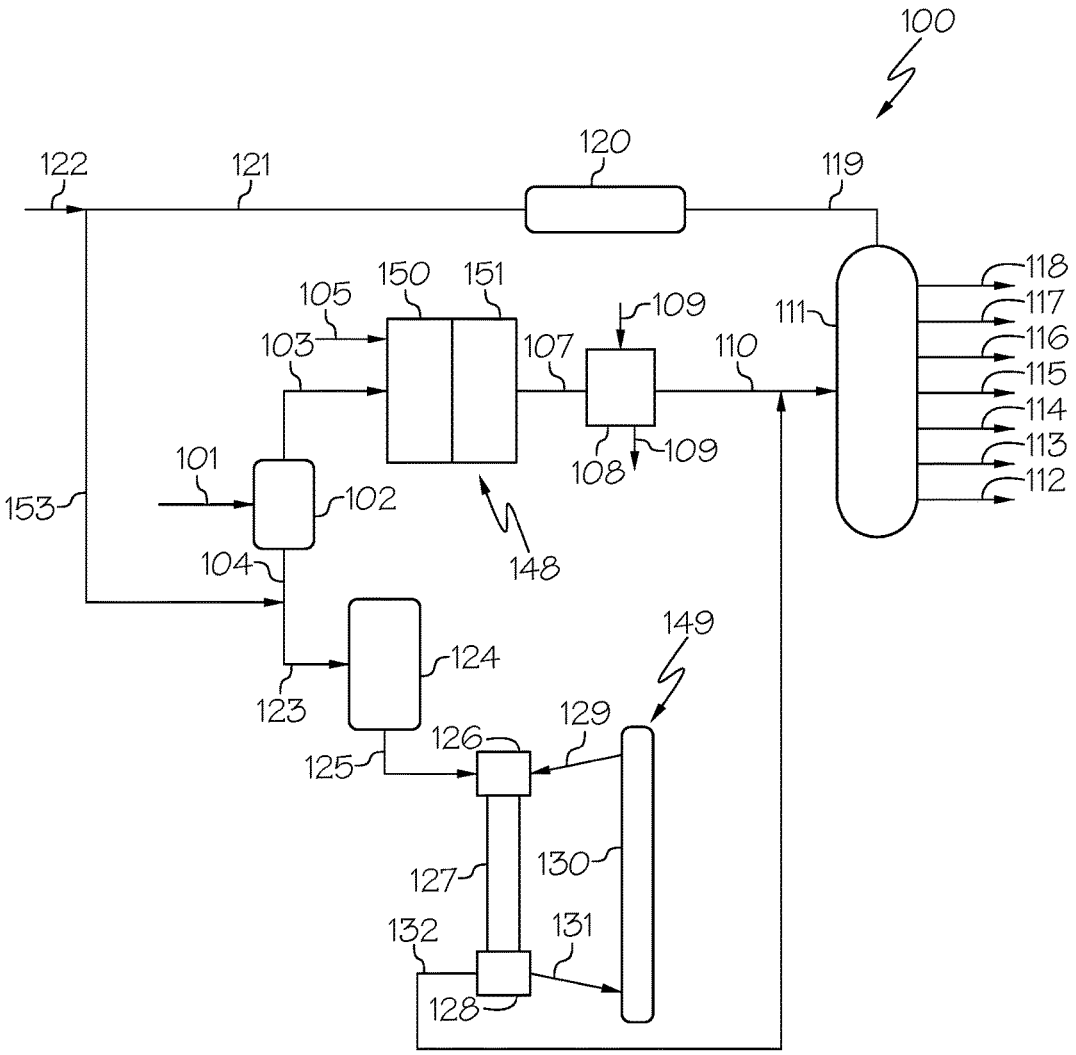
FIG. 1 depicts a generalized schematic diagram of an embodiment of a crude oil conversion system, according to one or more embodiments described in this disclosure.
Figure 2:
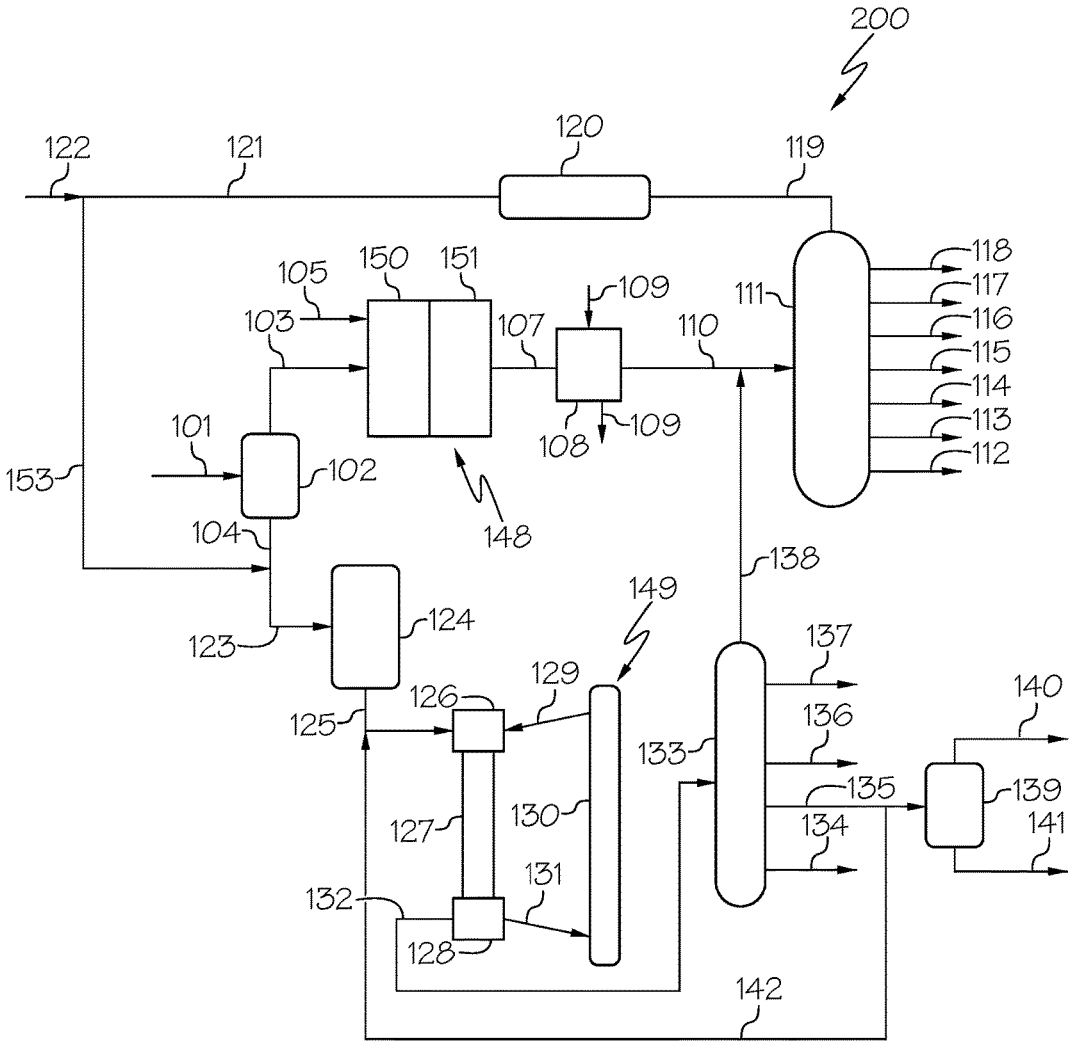
FIG. 2 depicts a generalized schematic diagram of another embodiment of a crude oil conversion system, according to one or more embodiments described in this disclosure.
Figure 3:
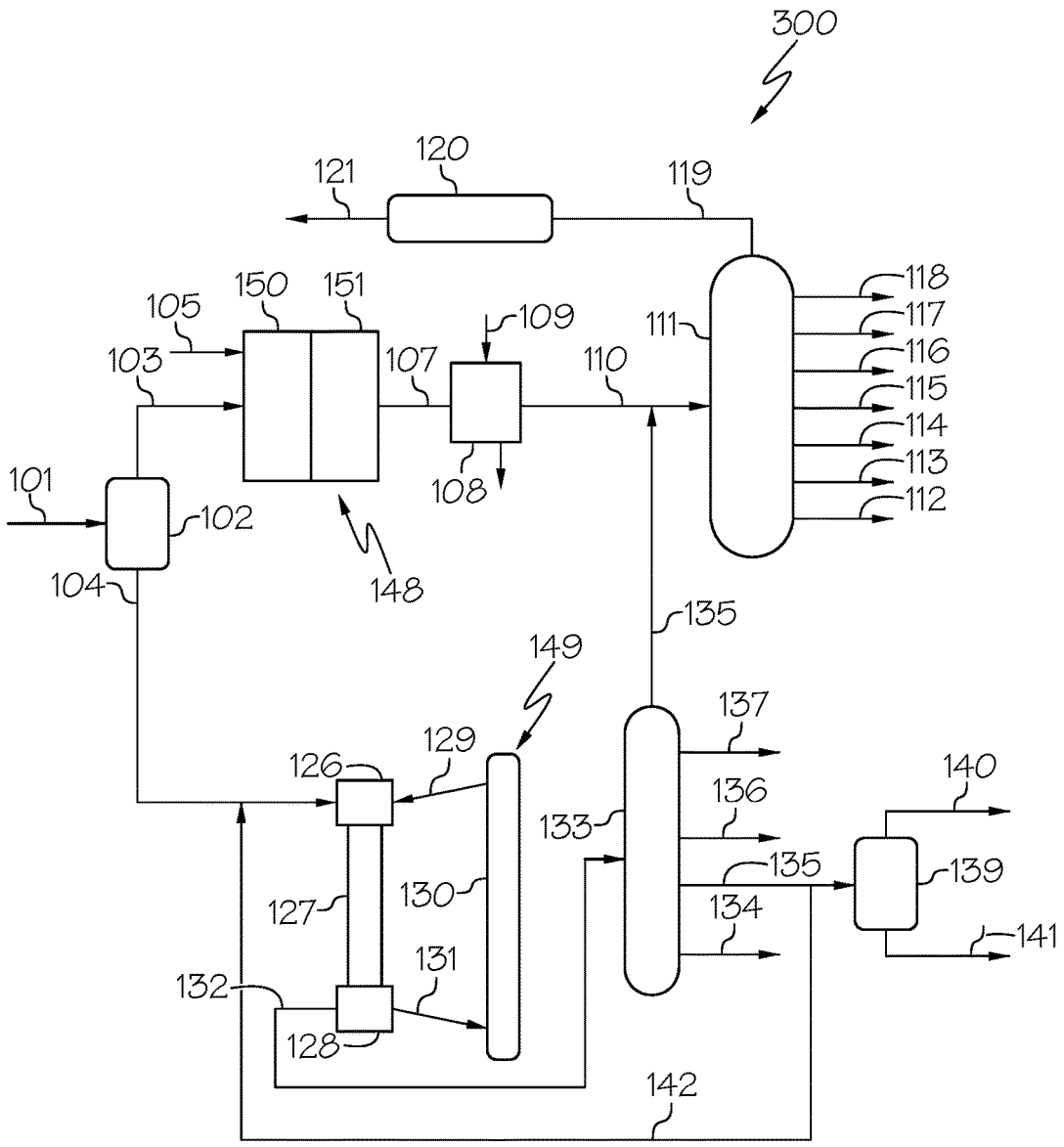
FIG. 3 depicts a generalized schematic diagram of another embodiment of a crude oil conversion system, according to one or more embodiments described in this disclosure.

For the purpose of describing the simplified schematic illustrations and descriptions of FIGS. 1-3, the numerous valves, temperature sensors, electronic controllers and the like that may be employed and well known to those of ordinary skill in the art of certain chemical processing operations are not included. Further, accompanying components that are often included in conventional chemical processing operations, such as refineries, such as, for example, air supplies, catalyst hoppers, and flue gas handling are not depicted. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process steams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1-3. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Described in this disclosure are various embodiments of systems and methods for processing feedstock hydrocarbons, such as crude oil, into petrochemical products such as light olefins. Generally, the processing of the feedstock hydrocarbon may include separating crude oil into a lesser boiling point hydrocarbon fraction and a greater boiling point hydrocarbon fraction, and then processing the greater boiling point hydrocarbon fraction in a high-severity fluid catalytic cracking (HS-FCC) reaction and processing the lesser boiling point hydrocarbon fraction in a stream cracking reaction. The products of the HS-FCC reaction and the steam cracking reaction may be further separated into desired petrochemical product streams. For example, crude oil may be utilized as a feedstock hydrocarbon and be directly processed into one or more of hydrocarbon oil, gasoline, mixed butenes, butadiene, propene, ethylene, methane, hydrogen, mixed $C_4$, naphtha, and liquid petroleum gas.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals that are mixed in a process stream from one another. For example, a separation unit may selectively separate differing chemical species from one another, forming one or more chemical fractions. Examples of separation units include, without limitation, distillation columns, flash drums, knock-out drums, knock-out pots, centrifuges, filtration devices, traps, scrubbers, expansion devices, membranes, solvent extraction devices, and the like. It should be understood that separation processes described in this disclosure may not completely separate all of one chemical consistent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a "lesser boiling point fraction" (sometimes referred to as a "light fraction") and a "greater boiling point fraction" (sometimes referred to as a "heavy fraction") may exit the separation unit, where, on average, the contents of the lesser boiling point fraction stream have a lesser boiling point than the greater boiling point fraction stream. Other streams may fall between the lesser boiling point fraction and the greater boiling point fraction, such as an "intermediate boiling point fraction."

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance which increases the rate of a specific chemical reaction. Catalysts described in this disclosure may be utilized to promote various reactions, such as, but not limited to, cracking (including aromatic cracking), demetalization, dearomatization, desulfurization, and, denitrogenation. As used in this disclosure, "cracking" generally refers to a chemical reaction where a molecule having carbon to carbon bonds is broken into more than one molecule by the breaking of one or more of the carbon to carbon bonds, or is converted from a compound which includes a cyclic moiety, such as an aromatic, to a compound which does not include a cyclic moiety or contains fewer cyclic moieties than prior to cracking.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing from a first system component to a second system component should be understood to equivalently disclose "hydrogen" passing from a first system component to a second system component.

Now referring to FIG. 1, a hydrocarbon conversion system 100 is schematically depicted. The hydrocarbon conversion system 100 generally receives a feedstock hydrocarbon stream 101 and directly processes the feedstock hydrocarbon stream 101 to form one or more petrochemical product streams. While the present description and examples may specify crude oil as the material of the feedstock hydrocarbon stream 101, it should be understood that the hydrocarbon conversion systems 100, 200, 300 described with respect to the embodiments of FIGS. 1-3, respectively, are applicable for the conversion of a wide variety of feedstock hydrocarbons (in feedstock hydrocarbon stream 101), including, but not limited to, crude oil, vacuum residue, tar sands, bitumen, atmospheric residue, and vacuum gas oils. If the feedstock hydrocarbon is crude oil, it may have an American Petroleum Institute (API) gravity of from 22 degrees to 40 degrees. For example, the feedstock hydrocarbon utilized may be an Arab heavy crude oil. Example properties for one particular grade of Arab heavy crude oil are shown in Table 1. Additionally, the Examples which follow include additional example crude oil feedstocks (both hydroprocessed and non-hydroprocessed). It should be understood that, as used in this disclosure, a "feedstock hydrocarbon" may refer to a raw hydrocarbon which has not been previously processed (such as crude oil) or may refer to a hydrocarbon which has undergone some degree of processing prior to being introduced to the hydrocarbon conversion system 100 in the feedstock hydrocarbon stream 101.

TABLE 1

Example of Arab Heavy Export Feedstock

| | Units | Value |
|---|---|---|
| Analysis | | |
| American Petroleum Institute (API) gravity | degree | 27 |
| Density | grams per cubic centimeter ($g/cm^3$) | 0.8904 |
| Sulfur Content | weight percent (wt. %) | 2.83 |
| Nickel | parts per million by weight (ppmw) | 16.4 |
| Vanadium | ppmw | 56.4 |
| Sodium Chloride (NaCl) Content | ppmw | <5 |
| Conradson Carbon Residue (CCR) | wt. % | 8.2 |
| $C_5$ Asphaltenes | wt. % | 7.8 |
| $C_7$ Asphaltenes | wt. % | 4.2 |

Still referring to FIG. 1, the feedstock hydrocarbon stream 101 may be introduced to a feedstock hydrocarbon separator 102 which separates the contents of the feedstock hydrocarbon stream 101 into a lesser boiling point hydrocarbon fraction stream 103 and a greater boiling point hydrocarbon fraction stream 104. In one or more embodiments, the feedstock hydrocarbon stream 101 may be a vapor-liquid separator such as a flash drum (sometimes referred to as a breakpot, knock-out drum, knock-out pot, compressor suction drum, or compressor inlet drum). In such an embodiment utilizing a vapor-liquid separator as the feedstock hydrocarbon separator 102, the lesser boiling point hydrocarbon fraction stream 103 exits the feedstock hydrocarbon separator 102 as a vapor and the greater boiling point hydrocarbon fraction stream 104 exits the feedstock hydrocarbon separator 102 as a liquid. The vapor-liquid separator may be operated at a temperature suitable to separate the feedstock hydrocarbon stream 101 into the lesser boiling point hydrocarbon fraction stream 103 and the greater boiling point hydrocarbon fraction stream 104, such as from 180 degrees Celsius (° C.) to 400° C. For example, the contents of the lesser boiling point hydrocarbon fraction stream 103 may have a boiling point of at least about 180° C. and less than or equal to 400° C., less than or equal to 350° C., less than or equal to 300° C., less than or equal to 250° C., or less than or equal to 200° C. The contents of the greater boiling point hydrocarbon fraction stream 104 may have a boiling point of less than or equal to 400° C. and at least 180° C., at least 200° C., at least 250° C., at least 300° C., or even at least 350° C.

Following the separation of the feedstock hydrocarbon stream 101 into the lesser boiling point hydrocarbon fraction stream 103 and the greater boiling point hydrocarbon fraction stream 104, the lesser boiling point hydrocarbon fraction stream 103 may be passed to a steam cracker unit 148. The steam cracker unit 148 may include a convection zone 150 and a pyrolysis zone 151. The lesser boiling point hydrocarbon fraction stream 103 may pass into the convection zone 150 along with steam 105. In the convection zone 150, the lesser boiling point hydrocarbon fraction stream 103 may be pre-heated to a desired temperature, such as from 400° C. to 650° C. The contents of the lesser boiling point hydrocarbon fraction stream 103 present in the convection zone 150 may then be passed to the pyrolysis zone 151 where it is steam-cracked. The steam-cracked effluent stream 107 may exit the steam cracker unit 148 and be passed through a heat exchanger 108 where process fluid 109, such as water or pyrolysis hydrocarbon oil, cools the steam-cracked effluent stream 107 to form the cooled steam-cracked effluent stream 110. The steam-cracked effluent stream 107 and cooled steam-cracked effluent stream 110 may include a mixture of cracked hydrocarbon-based materials which may be separated into one or more petrochemical products included in one or more system product streams. For example, the steam-cracked effluent stream 107 and the cooled steam-cracked effluent stream 110 may include one or more of hydrocarbon oil, gasoline, mixed butenes, butadiene, propene, ethylene, methane, and hydrogen, which may further be mixed with water from the stream cracking.

According to one or more embodiments, the pyrolysis zone 151 may operate at a temperature of from 700° C. to 900° C. The pyrolysis zone 151 may operate with a residence time of from 0.05 seconds to 2 seconds. The mass ratio of steam 105 to lesser boiling point hydrocarbon fraction stream 103 may be from about 0.3:1 to about 2:1.

The greater boiling point hydrocarbon fraction stream 104 may exit the feedstock hydrocarbon separator 102 and be combined with a hydrogen stream 153 to form a mixed stream 123. The hydrogen stream 153 may be supplied from a source outside of the system, such as feed hydrogen stream 122, or may be supplied from a system recycle stream, such as purified hydrogen stream 121. In another embodiment, the hydrogen stream 153 may be from a combination of sources such as partially being supplied from feed hydrogen stream 122 and partially supplied from purified hydrogen stream 121. The volumetric ratio of components from the hydrogen stream 153 to components of the greater boiling point hydrocarbon fraction stream 104 present in the mixed stream 123 may be from 400:1 to 1500:1, and may depend on the contents of the greater boiling point hydrocarbon fraction stream 104.

The mixed stream 123 may then be introduced to a hydroprocessing unit 124. The hydroprocessing unit 124 may at least partially reduce the content of metals, nitrogen, sulfur, and aromatic moieties. For example, the hydroprocessed effluent stream 125 which exits the hydroprocessing unit 124 may have reduced content of one or more of metals, nitrogen, sulfur, and aromatic moieties by at least 2%, at least 5%, at least 10%, at least 25%, at least 50%, or even at least 75%. For example, a hydrodemetalization (HDM) catalyst may remove a portion of one or more metals from a process stream, a hydrodenitrogenation (HDN) catalyst may remove a portion of the nitrogen present in a process stream, and a hydrodesulfurization (HDS) catalyst may remove a portion of the sulfur present in a process stream. Additionally, a hydrodearomatization (HDA) catalyst may reduce the amount of aromatic moieties in a process stream by saturating and cracking those aromatic moieties. It should be understood that a particular catalyst is not necessarily limited in functionality to the removal or cracking of a particular chemical constituent or moiety when it is referred to as having a particular functionality. For example, a catalyst identified in this disclosure as an HDN catalyst may additionally provide HDA functionality, HDS functionality, or both.

According to one or more embodiments, the hydroprocessing unit 124 may include multiple catalyst beds arranged in series. For example, the hydroprocessing unit 124 may comprise one or more of a hydrocracking catalyst, a hydrodemetalization catalyst, a hydrodesulfurization catalyst, and a hydrodenitrogenation catalyst, arranged in series. The catalysts of the hydroprocessing unit 124 may comprise one or more IUPAC Group 6, Group 9, or Group 10 metal catalysts such as, but not limited to, molybdenum, nickel, cobalt, and tungsten, supported on a porous alumina or zeolite support. As used in this disclosure, the hydroprocessing unit 124 serves to at least partially reduce the content of metals, nitrogen, sulfur, and aromatic moieties in the mixed stream 123, and should not be limited by the materials utilized as catalysts in the hydroprocessing unit 124. According to one embodiment, one or more catalysts utilized to reduce sulfur, nitrogen, and metals content may be positioned upstream of a catalyst which is utilized to hydrogenate or crack the reactant stream. According to one or more embodiments, the hydroprocessing unit 124 may operate at a temperature of from 300° C. to 450° C. and at a pressure of from 30 bars to 180 bars. The hydroprocessing unit 124 may operate with a liquid hour space velocity of from 0.3/hour to 10/hour.

According to one or more embodiments, the contents of the stream entering the hydroprocessing unit 124 may have a relatively large amount of one or more of metals (for example, Vanadium, Nickel, or both), sulfur, and nitrogen. For example, the contents of the stream entering the hydroprocessing unit may comprise one or more of greater than 17 parts per million by weight of metals, greater than 135 parts per million by weight of sulfur, and greater than 50 parts per million by weight of nitrogen. The contents of the stream exiting the hydroprocessing unit 124 may have a relatively small amount of one or more of metals (for example, Vanadium, Nickel, or both), sulfur, and nitrogen. For example, the contents of the stream exiting the hydroprocessing unit may comprise one or more of 17 parts per million by weight of metals or less, 135 parts per million by weight of sulfur or less, and 50 parts per million by weight of nitrogen or less.

The hydroprocessed effluent stream 125 may exit the hydroprocessing unit 124 and be passed to a high-severity fluid catalytic cracking reactor unit 149. The high-severity fluid catalytic cracking reactor unit 149 may include a catalyst/feed mixing zone 126, a down flow reaction zone 127, a separation zone 128, and a catalyst regeneration zone 130. The hydroprocessed effluent stream 125 may be introduced to the catalyst/feed mixing zone 126 where it is mixed with regenerated catalyst from regenerated catalyst stream 129 passed from the catalyst regeneration zone 130. The hydroprocessed effluent stream 125 is reacted by contact with the regenerated catalyst in the reaction zone 127, which cracks the contents of the hydroprocessed effluent stream 125. Following the cracking reaction in the reaction zone 127, the contents of the reaction zone 127 are passed to the separation zone 128 where the cracked product of the reaction zone 127 is separated from spent catalyst, which is passed in a spent catalyst stream 131 to the catalyst regeneration zone 130 where it is regenerated by, for example, removing coke from the spent catalyst.

It should be understood that high-severity fluid catalytic cracking reactor unit 149 is a simplified schematic of one particular embodiment of a high-severity fluid catalytic cracking reactor unit, and other configurations of high-severity fluid catalytic cracking reactor units may be suitable for incorporation into the hydrocarbon conversion system 100. However, the high-severity fluid catalytic cracking reactor unit 149 may generally be defined by its incorporation of fluidized catalyst contacting the reactant at an elevated temperature of, for example, at least 500° C. According to one or more embodiments, the reaction zone 127 of the high-severity fluid catalytic cracking reactor unit 149 may operate at a temperature of from 530° C. to 700° C. with a weight ratio of catalyst to contents of the hydroprocessed effluent stream 125 of 10 wt. % to 40 wt. %. The residence time of the mixture in the reaction zone 127 may be from 0.2 to 2 seconds. A variety of fluid catalytic cracking catalysts may be suitable for the reactions of the high-severity fluid catalytic cracking reactor unit 149. For example, some suitable fluid catalytic cracking catalysts may include, without limitation, zeolites, silica-alumina, carbon monoxide burning promoter additives, bottoms cracking additives, light olefin-producing additives, and other catalyst additives used in the FCC processes. Example of cracking zeolites suitable for use in the high-severity fluid catalytic cracking reactor unit 149 include Y, REY, USY, and RE-USY zeolites. For enhanced light olefins production from naphtha cracking, ZSM-5 zeolite crystal or other pentasil type catalyst structure may be used.

The catalytically-cracked effluent stream 132 may exit the separation zone 128 of the high-severity fluid catalytic cracking reactor unit 149 and be combined with the cooled steam-cracked effluent stream 110, which was processed by the steam cracker unit 148. The combined stream containing the cooled steam-cracked effluent stream 110 and the catalytically-cracked effluent stream 132 may be separated by separation unit 111 into system product streams. For example, the separation unit 111 may be a distillation column which separates the contents of the cooled steam-cracked effluent stream 110 and the catalytically-cracked effluent stream 132 into one or more of a hydrocarbon oil stream 112, a gasoline stream 113, a mixed butenes stream 114, a butadiene stream 115, a propene stream 116, an ethylene stream 117, a methane stream 118, and a hydrogen stream 119. The cooled steam-cracked effluent stream 110 may be mixed with the catalytically-cracked effluent stream 132 prior to introduction to the separation unit 111 as depicted in FIG. 1, or alternatively, the separation unit 111 and the catalytically-cracked effluent stream 132 may be individually introduced into the separation unit 111. As used in this disclosure, the system product streams (such as the hydrocarbon oil stream 112, the gasoline stream 113, the mixed butenes stream 114, the butadiene stream 115, the propene stream 116, the ethylene stream 117, and the methane stream 118) may be referred to as petrochemical products, sometimes used as intermediates in downstream chemical processing.

As depicted in FIG. 1, the hydrogen stream 119 may be processed by a hydrogen purification unit 120 and recycled back into the hydrocarbon conversion system 100 as purified hydrogen stream 121. The purified hydrogen stream 121 may be supplemented with additional feed hydrogen from feed hydrogen stream 122. Alternatively, all or at least a portion of the hydrogen stream 119 or the purified hydrogen stream 121 may exit the system as system products or be burned for heat generation.

Now referring to FIG. 2, a hydrocarbon conversion system 200 is depicted which in some aspects is similar or identical to hydrocarbon conversion system 100, but where the catalytically-cracked effluent stream 132 is separated in cracking reactor separator 133 prior to any of its components being introduced to the separation unit 111. The catalytically-cracked effluent stream 132 may be passed from the high-severity fluid catalytic cracking reactor unit 149 to the cracking reactor separator 133, which may be a distillation column. The cracking reactor separator 133 may separate the contents of the catalytically-cracked effluent stream 132 into one or more of a light cycle oil stream 134, a naphtha steam 135, an ethylene stream 136, a propylene stream 137, and a liquefied petroleum gas (including mixed C4) stream 138. The naphtha stream 135 may be further separated into a lesser boiling point naphtha stream 140 and a greater boiling point naphtha stream 141 in a naphtha separator 139. All or a portion of the naphtha stream 135 may be recycled back into the hydrocarbon conversion system 200 via the naphtha recycle stream 142 which combines the naphtha stream 135 with the hydroprocessed effluent stream 125 prior to the hydroprocessed effluent stream 125 being introduced to the high-severity fluid catalytic cracking reactor unit 149. As used in this disclosure, system product streams (such as the light/heavy cycle oil stream 134, the naphtha steam 135, the ethylene stream 136, the propylene stream 137, the liquefied petroleum gas stream 138, the naphtha separator 139, and the lesser boiling point naphtha stream 140) may be referred to as petrochemical products, sometimes used as intermediates in downstream chemical processing.

The liquefied petroleum gas stream 138 may exit the cracking reactor separator 133 and be combined with the cooled steam-cracked effluent stream 110. The combined stream containing the cooled steam-cracked effluent stream 110 and the liquefied petroleum gas stream 138 may be separated by a separation unit 111 into system product streams. For example, similar to the embodiment of FIG. 1, the separation unit 111 may be a distillation column which separates the contents of the cooled steam-cracked effluent stream 110 and the liquefied petroleum gas stream 138 into one or more of a hydrocarbon oil stream 112, a gasoline stream 113, a mixed butenes stream 114, a butadiene stream 115, a propene stream 116, an ethylene stream 117, a methane stream 118, and a hydrogen stream 119. The cooled steam-cracked effluent stream 110 may be mixed with the liquefied petroleum gas stream 138 prior to introduction to the separation unit 111 as depicted in FIG. 2, or alternatively, the cooled steam-cracked effluent stream 110 and the liquefied petroleum gas stream 138 may be individually introduced into the separation unit 111. In another embodiment, at least a portion of the liquefied petroleum gas stream 138 may exit the hydrocarbon conversion system 200 as a system product.

Now referring to FIG. 3, a hydrocarbon conversion system 300 is depicted which in some aspects is similar or identical to hydrocarbon conversion system 100 or 200, but where the contents of the greater boiling point hydrocarbon fraction stream 104 may be passed to the high-severity fluid catalytic cracking reactor unit 149 without the intermediate processing in a hydroprocessing reactor (such as the hydroprocessing unit 124 depicted in the embodiments of FIGS. 1 and 2). In such an embodiment, the naphtha recycle stream 142 may be combined with the greater boiling point hydrocarbon fraction stream 104 prior to their introduction to the high-severity fluid catalytic cracking reactor unit 149. Additionally, in such an embodiment, hydrogen may not be introduced to the greater boiling point hydrocarbon fraction stream 104 since the hydrogen is no longer needed for the hydroprocessing reactions of a hydroprocessing reactor.

In the embodiments where the greater boiling point hydrocarbon fraction stream 104 is not hydroprocessed to reduce nitrogen, sulfur, aromatics, metals, and combinations of such, the greater boiling point hydrocarbon fraction stream 104 may be introduced to the high-severity fluid catalytic cracking reactor unit 149 comprising a composition having one or more of greater than 17 parts per million by weight of metals, greater than 135 parts per million by weight of sulfur, and greater than 50 parts per million by weight of nitrogen.

Furthermore, it should be understood that the embodiment of FIG. 3, which does not include a hydroprocessing reactor, may be suitable in conjunction with the separation scheme depicted in FIG. 1, where the contents of the catalytically-cracked effluent stream 132 are separated along with the contents of the cooled steam-cracked effluent stream 110 in the separation unit 111.

According to the embodiments disclosed with reference to FIGS. 1-3, a number of advantages may be present over conventional conversion systems which do not separate the feedstock hydrocarbon stream 101 into two or more streams prior to introduction into a cracking unit such as a steam cracker unit. That is, conventional cracking units which inject the entirety of the feedstock hydrocarbon into a steam cracker may be deficient in certain respects as compared with the conversions systems of FIGS. 1-3. For example, by separating the feedstock hydrocarbon stream 101 prior to introduction into a steam cracking unit, a higher amount of light-fraction system products may be produced. According to the embodiments presently described, by only introducing the lesser boiling point hydrocarbon fraction stream 103 to the steam cracker unit 148, the amount of lesser boiling point products such as hydrogen, methane, ethylene, propene, butadiene, and mixed butenes may be increased, while the amount of greater boiling point products such as hydrocarbon oil can be reduced. At the same time, the greater boiling point hydrocarbon fraction stream 104 can be converted via the high-severity fluid catalytic cracking reactor unit 149 into other valuable system products such as light cycle oil, naphtha, mixed $C_4$, ethylene and propylene.

According to another embodiment, coking in the steam cracker unit 148 may be reduced by the elimination of materials present in the greater boiling point hydrocarbon fraction stream 104. Without being bound by theory, it is believed that highly aromatic feeds into a steam cracker unit may result in greater boiling point products and increased coking. Thus, it is believed that coking can be reduced and greater quantities of lesser boiling point products can be produced by the steam cracker unit 148 when highly-aromatic materials are not introduced to the steam cracker unit 148 and are instead separated into at least a portion of the greater boiling point hydrocarbon fraction stream 104 by the feedstock hydrocarbon separator 102.

According to another embodiment, capital costs may be reduced by the designs of the hydrocarbon conversion systems 100, 200, 300 of FIGS. 1-3. Since the feedstock hydrocarbon stream 101 is fractionated by the feedstock hydrocarbon separator 102, not all of the cracking furnaces of the system need to be designed to handle the materials contained in the greater boiling point hydrocarbon fraction stream 104. It is expected that system components designed to treat lesser boiling point materials such as those contained in the lesser boiling point hydrocarbon fraction stream 103 would be less expensive than system components designed to treat greater boiling point materials, such as those contained in the greater boiling point hydrocarbon fraction stream 104. For example, the convection zone 150 of the steam cracker unit 148 can be designed simpler and cheaper than an equivalent convection zone that is designed to process the materials of the greater boiling point hydrocarbon fraction stream 104.

According to another embodiment, system components such as vapor-solid separation devices and vapor-liquid separation devices may not need to be utilized between the convection zone 150 and the pyrolysis zone 151 of the steam cracker unit 148. In some conventional steam cracker units, a vapor-liquid separation device may be required to be positioned between the convection zone and the pyrolysis zone. This vapor-liquid separation device may be used to remove the greater boiling point components present in a convection zone, such as any vacuum residues. However, in some embodiments of the hydrocarbon conversion systems 100, 200, 300 of FIGS. 1-3, a vapor-liquid separation device may not be needed, or may be less complex since it does not encounter greater boiling point materials such as those present in the greater boiling point hydrocarbon fraction stream 104. Additionally, in some embodiments described, the steam cracker unit 148 may be able to be operated more frequently (that is, without intermittent shut-downs) caused by the processing of relatively heavy feeds. This higher frequency of operation may sometimes be referred to as increased on-stream-factor.

EXAMPLES

The various embodiments of methods and systems for the conversion of a feedstock hydrocarbons will be further clarified by the following examples. The examples are illustrative in nature, and should not be understood to limit the subject matter of the present disclosure.

Comparative Example A

Product yields were determined by experimentation with a steam cracker pilot plant utilizing a hydroprocessed Arab light crude oil as feedstock. Table 2A shows the Arab light crude oil utilized as the feedstock before and after hydroprocessing. The hydroprocessed Arab light crude oil was pre-cut at 540° C. to remove greater boiling point fractions from the feedstock to simulate the effect of a vapor-liquid separation device utilized in conventional steam cracker units between the convection zone and the pyrolysis zone. A cracking severity of 840° C. coil outlet temperature was used for testing. The product yields for Comparative Example A are shown in Table 2B.

TABLE 2A

| | Arab light crude oil (prior to hydrotreating) | Hydrotreated Arab light crude oil |
|---|---|---|
| Properties | | |
| Density (grams per milliliter (g/ml)) | 0.8595 | 0.8422 |
| Hydrogen (wt. %) | 12.68 | 13.61 |
| Sulfur, (ppmw) | 19400 | 61 |
| Nitrogen (ppmw) | 849 | 49 |
| V (ppmw) | 15 | — |
| Ni (ppmw) | 12 | — |
| Composition (wt. %) | | |
| $C_5$-180° C. | 18.0 | 17.4 |
| 180-350° C. | 28.8 | 38.1 |
| 350-540° C. | 27.4 | 31.2 |
| >540° C. | 25.8 | 13.3 |

TABLE 2B

| Product | wt. % |
|---|---|
| Hydrogen | 0.79 |
| Methane | 10.83 |
| Ethene | 25.02 |
| Ethane | — |
| Propene | 10.29 |
| Propane | — |
| Butadiene | 4.15 |
| Butenes | 2.41 |
| Butane | — |
| Benzene | 5.35 |
| Toluene | 2.79 |
| Pyrolysis gasoline | 7.66 |
| Pyrolysis Hydrocarbon Oil | 16.83 |
| Hydrocarbon Oil | 12.35 |
| Coke | — |
| Ammonia ($NH_3$) | 0.14 |
| Acid Gas ($H_2S$) | 1.39 |

Example 1

Product yields were computer modeled for the reactor systems depicted in FIGS. 1 and 2 where the crude oil feedstock of Table 2A was separated into two fractions and subsequently processed in a steam cracker unit and high-severity fluid catalytic cracking reactor unit, respectively. The high-severity fluid catalytic cracking reaction was computer modeled using an HS-FCC ASPEN simulation and the steam cracking reaction was modeled in SPYRO. The model was based on the Arab light crude oil being separated into fractions having a boiling point of greater than 345° C. (processed in the HS-FCC reactor) and less than 345° C. (processed in the steam cracker). The model accounted for the fraction fed to the HS-FCC reactor being hydrotreated to remove a portion of nitrogen, sulfur, and metals prior to its cracking in the HS-FCC reactor. The composition of the feed following hydroprocessing was experimentally determined in a pilot plant, and was the same as shown in Table 2A with reference to Comparative Example A. The model recycled $nC_2$, $nC_3$, and $nC_4$ to extinction in the steam cracking section. The SPYRO simulation accounted for a coil outlet temperature of 840° C., an inlet pressure of 253.852 megapascals (MPa), a steam to oil ratio of 0.7, a residence time of 0.233 seconds, and an outlet velocity of 187.712 meters per second (m/s). Table 3 shows the product yields for the integrated cracking scheme of Example 1, Table 4 shows the product yields for the lesser boiling point fraction cracked in the steam cracker, and Table 5 shows the product yields for the greater boiling point fraction cracked in the HS-FCC.

TABLE 3

| Product | wt. % |
|---|---|
| Hydrogen | 0.6 |
| Methane | 7.1 |
| Ethene | 18.93 |
| Ethane | — |
| Propene | 16.3 |
| Propane | — |
| Butadiene | 2.92 |
| Butenes | 9.33 |
| Butane | 1.5 |
| Benzene | 3.51 |
| Toluene | 2.78 |
| Pyrolysis gasoline | 18.76 |
| Pyrolysis | 13.36 |
| Hydrocarbon Oil | |
| Hydrocarbon Oil | — |
| Coke | 4.09 |
| $NH_3$ | 0.07 |
| Acid Gas $H_2S$ | 0.75 |

TABLE 4

| Component | wt. % |
|---|---|
| Hydrogen | 0.99 |
| Methane | 12.29 |
| Ethene | 32.04 |
| Propene | 14.76 |
| Butadiene | 5.49 |
| Butenes | 3.98 |
| Butane | 0.15 |
| Benzene | 6.36 |
| Toluene | 3.69 |
| Pyrolysis gasoline | 11.37 |
| Pyrolysis hydrocarbon oil | 8.88 |

TABLE 5

| Component | wt. % |
|---|---|
| $H_2S$ | 0.1 |
| Hydrogen | 0.1 |
| Methane | 1.2 |
| Ethane | 1 |
| Ethylene | 3.6 |
| Propane | 1.3 |
| Propylene | 18.1 |
| Butane (n+ iso) | 3 |
| Mixed $C_4$ | 15.4 |
| Gasoline ($C_5$-182° C.) | 29.2 |
| LCO-Hydrocarbon Oil | 14.5 |
| Slurry-Hydrocarbon Oil | 3.9 |
| Coke | 8.6 |

Example 2

Product yields were modeled for the reactor systems depicted in FIG. 3 where a crude oil feedstock was separated into two fractions and subsequently processed in a steam cracker unit and high-severity fluid catalytic cracking reactor unit, respectively, without the utilization of hydroprocessing. The integrated system was modeled in ASPEN with the high-severity fluid catalytic cracking reaction data observed using a bench scaled-down fluid catalytic cracking unit at 600° C. and catalyst to oil ratio of about 30, and the steam cracking reaction data produced by a model in SPYRO utilizing the same process parameters as disclosed in Example 1. The model was based on the light Arab crude oil being separated into fractions having a boiling point of greater than 350° C. (processed in the HS-FCC reactor) and less than 350° C. (processed in the steam cracker). The feedstock for which the model was conducted was the Arab light crude oil of Table 2A without hydroprocessing. The model recycled $nC_2$, $nC_3$, and $nC_4$ to extinction in the steam cracking section with a cracking severity of 840° C. coil outlet temperature and a steam to oil ratio of 0.5. Table 6 shows the product yields for the lesser boiling point fraction cracked in the steam cracker, and Table 7 shows the product yields for the greater boiling point fraction cracked in the HS-FCC.

TABLE 6

| Component | wt. % |
|---|---|
| $H_2$ | 0.71 |
| $CH_4$ | 11.17 |
| $C_2H_2$ | 0.34 |
| $C_2H_4$ | 24.54 |
| $C_2H_6$ | 3.2 |
| MAC | 0.35 |
| PPD | 0.23 |
| $C_3H_6$ | 14.63 |
| $C_3H_8$ | 0.43 |
| $C_4H_4$ | 0.03 |
| Butadiene | 5.05 |
| Butane | 0.13 |
| Butenes | 5.32 |
| $C_5$-$C_9$ | 23.71 |
| $C_{10}$+ | 9.93 |
| CO | 0.17 |
| $CO_2$ | 0.01 |

TABLE 7

| Component | Wt % |
|---|---|
| $C_2$ & Lighter | 8.8 |
| Total $C_3$ | 21.9 |
| Total $C_4$ | 16.8 |
| Gasoline ($C_5$-216° C.) | 26.47 |
| LCO (216-343° C.) | 11.8 |
| HCO (>343° C.) | 7.9 |
| Coke Yield | 6.3 |

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A method for processing a feedstock hydrocarbon, the method comprising:

separating the feedstock hydrocarbon into a lesser boiling point hydrocarbon fraction and a greater boiling point hydrocarbon fraction;

cracking the greater boiling point hydrocarbon fraction in a high-severity fluid catalytic cracking reactor unit to form a catalytically cracked effluent, wherein the high-severity fluid catalytic cracking reactor operates at a temperature of at least 500° C.;

cracking the lesser boiling point hydrocarbon fraction in a steam cracker unit to form a steam cracked effluent; and separating one or both of the catalytically cracked effluent or the steam cracked effluent to form two or more petrochemical products.

2. The method of claim 1, where the feedstock hydrocarbon comprises crude oil.

3. The method of claim 1, where one of the petrochemical products comprise one or more of methane, ethene, propene, butene, or butadiene.

4. The method of claim 1, further comprising hydroprocessing the greater boiling point hydrocarbon fraction prior to the heavy crude fraction being cracked in the high-severity fluid catalytic cracking reactor unit, where the hydroprocessing comprises reducing the content of one or more of sulfur, metals, aromatics, and nitrogen in the greater boiling point hydrocarbon fraction.

5. The method of claim 4, further comprising combining the greater boiling point hydrocarbon fraction with hydrogen prior to being introduced to the high-severity fluid catalytic cracking reactor unit.

6. The method of claim 5, where at least a portion of hydrogen that is combined with the greater boiling point hydrocarbon fraction is a petrochemical product such that it is recycled.

7. The method of claim 1, where feedstock hydrocarbon is separated into the lesser boiling point hydrocarbon fraction and the greater boiling point hydrocarbon fraction by flashing.

8. The method of claim 1, where contents of the lesser boiling point hydrocarbon fraction have a boiling point of less than or equal to 400° C. and the contents of the greater boiling point hydrocarbon fraction have a boiling point of at least 180° C., and the boiling point of the contents of the greater boiling point hydrocarbon fraction is greater than the boiling point of the contents of the lesser boiling point hydrocarbon fraction.

9. The method of claim 1, where the greater boiling point hydrocarbon fraction that is cracked comprises one or more of:

at least 17 parts per million by weight of metals;

at least 135 parts per million by weight of sulfur; and at least 50 parts per million by weight of nitrogen.

10. The method of claim 1, further comprising combining the catalytically cracked effluent and the steam cracked effluent.

11. The method of claim 1, further comprising:

separating naphtha from the catalytically cracked effluent with a first separator; and combining the naphtha with the steam cracked effluent.

12. A method for processing a feedstock hydrocarbon, the method comprising:

introducing a feedstock hydrocarbon stream to a feedstock hydrocarbon separator that separates the feedstock hydrocarbon into a lesser boiling point hydrocarbon fraction stream and a greater boiling point hydrocarbon fraction stream;

passing the greater boiling point hydrocarbon fraction stream to a high-severity fluid catalytic cracking reactor unit that cracks the greater boiling point hydrocarbon fraction stream to form a catalytically cracked effluent stream, wherein the high-severity fluid catalytic cracking reactor operates at a temperature of at least 500° C.;

passing the lesser boiling point hydrocarbon fraction stream to a steam cracker unit that cracks the lesser boiling point hydrocarbon fraction stream to form a steam cracked effluent stream; and separating one or both of the catalytically cracked effluent stream or the steam cracked effluent stream to form two or more petrochemical product streams.

13. The method of claim 12, where the feedstock hydrocarbon stream comprises crude oil.

14. The method of claim 12, where one of the petrochemical product streams comprises butene.

15. The method of claim 12, further comprising passing the greater boiling point hydrocarbon fraction to a hydroprocessing unit positioned upstream of the fluid catalytic cracking reactor unit, where one or more of sulfur content, metals content, aromatics, or nitrogen content are reduced in the heavy crude fraction in the hydroprocessing unit prior to the greater boiling point hydrocarbon fraction being introduced to the fluid catalytic cracking reactor unit.

16. The method of claim 15, further comprising combining the greater boiling point hydrocarbon fraction stream with a hydrogen stream prior to being introduced to a hydroprocessing unit positioned upstream of the high-severity fluid catalytic cracking reactor unit.

17. The method of claim 16, where at least a portion of hydrogen in the hydrogen stream that is combined with the greater boiling point hydrocarbon fraction stream is from a petrochemical product stream such that it is recycled.

18. The method of claim 12, where the feedstock hydrocarbon stream is separated into the lesser boiling point hydrocarbon fraction stream and the greater boiling point hydrocarbon fraction stream by flashing.

19. The method of claim 12, where contents of the lesser boiling point hydrocarbon fraction stream have a boiling point of less than or equal to 400° C. and the contents of the greater boiling point hydrocarbon fraction stream have a boiling point of at least 280° C., and the boiling point of the contents of the greater boiling point hydrocarbon fraction stream is greater than the boiling point of the contents of the lesser boiling point hydrocarbon fraction stream.

20. The method of claim 12, where the greater boiling point hydrocarbon fraction stream that is cracked comprises one or more of:

at least 17 parts per million by weight of metals;

at least 135 parts per million by weight of sulfur; and at least 50 parts per million by weight of nitrogen.

21. The method of claim 12, further comprising combining the catalytically cracked effluent stream and the steam cracked effluent stream.

22. The method of claim 12, further comprising:

separating naphtha from the catalytically cracked effluent with a first separator to form a naphtha stream; and combining the naphtha stream with the steam cracked effluent stream.

* * * * *